US005626257A

United States Patent [19]

Carlson

[11] Patent Number: 5,626,257

[45] Date of Patent: May 6, 1997

[54] PAINT BLADDER

[76] Inventor: Leonard E. Carlson, 72 Washburn Ave., Rumford, R.I. 02916

[21] Appl. No.: 555,320

[22] Filed: Nov. 8, 1995

[51] Int. Cl.[6] ..... B65D 88/00

[52] U.S. Cl. ..... 220/578

[58] Field of Search ..... 220/721, 723, 220/403, 578; 137/855, 223; 222/632, 386.5; 383/3, 96

[56] References Cited

U.S. PATENT DOCUMENTS

| | | | |
|---|---|---|---|
| 2,864,394 | 12/1958 | Hempel | 137/855 X |
| 3,282,478 | 11/1966 | Russell | 220/356 X |
| 4,823,831 | 4/1989 | Jaw | 137/855 X |
| 4,836,397 | 6/1989 | Fowles | 220/356 X |
| 5,007,449 | 4/1991 | Marrone, II | 137/855 X |
| 5,245,991 | 9/1993 | Kawaguchi | 137/223 X |
| 5,249,692 | 10/1993 | Gunderson | 220/578 X |

*Primary Examiner*—Steven M. Pollard

[57] ABSTRACT

A paint bladder including a bladder that has an exterior surface and a top portion with a cylindrical extent. The extent has an external portion with a notch and an internal portion with a valve lip that is connected by a hinge. A cap capable of slidable engagement of the external portion of the cylindrical extent for closure. Included is a hollow inner core that is accessible through the cylindrical extent, and for air containment. A rigid tube is positioned within the cylindrical extent. The tube has a first end opening that is sealed by the valve lip and a second end opening. Lastly, the tube operates as an air valve when the second end opening receives an amount of air therethrough and into the hollow for expansion of the bladder when the cap is removed.

1 Claim, 3 Drawing Sheets

PAINT BLADDER

BACKGROUND OF THE INVENTION

1. Field of the Invention

The present invention relates to a paint bladder and more particularly pertains to placing an inflatable bladder with a constant diameter and variable length into a partially filled paint can, and further varying the length of the bladder with respect to the fill level of the paint can.

2. Description of the Prior Art

The use of inflatable containers is known in the prior art. More specifically, inflatable containers heretofore devised and utilized for the purpose of using as a bladder are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,334,072 to Epstein discloses an inflatable body and holder assembly. U.S. Pat. No. 5,294,112 to Smith discloses a bladder for use in a sportsball bin. U.S. Pat. No. 4,983,139 to McGrath discloses an inflatable container with self-sealing valve. U.S. Pat. No. 4,854,945 to Ferree and Beal discloses a bladder device and method for displacing air in a bottle bore shaft. Lastly, U.S. Pat. No. 4,470,218 to Yu discloses a toy balloon.

While these devices fulfill their respective, particular objectives and requirements, the aforementioned patents do not describe paint bladder that allows a pneumatic bladder to be inserted in a partially full paint can, and blown up to displace the air in the can, so as to prevent a skim from form over the top surface of the paint in the can.

In this respect, the paint bladder according to the present invention substantially departs from the conventional concepts and designs of the prior art, and in doing so provides an apparatus primarily developed for the purpose of placing an inflatable bladder with a constant diameter and variable length into a partially filled paint can, and further varying the length of the bladder with respect to the fill level of the paint can.

Therefore, it can be appreciated that there exists a continuing need for a new and improved paint bladder which can be used for placing an inflatable bladder with a constant diameter and variable length into a partially filled paint can, and further varying the length of the bladder with respect to the fill level of the paint can. In this regard, the present invention substantially fulfills this need.

SUMMARY OF THE INVENTION

In view of the foregoing disadvantages inherent in the known types of inflatable containers now present in the prior art, the present invention provides an improved paint bladder. As such, the general purpose of the present invention, which will be described subsequently in greater detail, is to provide a new and improved paint bladder and method which has all the advantages of the prior art and none of the disadvantages.

To attain this, the present invention essentially comprises a collapsible pneumatic bladder that has an elastomeric exterior surface, and a top portion, and a bottom portion. The top portion of the bladder has a cylindrical stem with an internal portion and an external portion. The internal portion has a valve lip that is connected by a flexible hinge integral the stem. Included is a generally cylindrical cap that has a ridge spaced from a bottom of the cap. The ridge encircles the cap along an interior diameter of the cap. The cap is capable of slidable engagement with the external portion of the cylindrical stem. The ridge allows the cap to be lockingly positioned around the external portion. A hollow inner core is included within the bladder. The core is for holding a pressurized inflation medium. The inner core has an inflated shape with a constant diameter and a variable length. The variable length approximates that of a paint level within the paint can in which the bladder is positioned. A rigid cylindrical tube is positioned within the cylindrical stem of the top portion of the bladder. The tube has a first end opening adjacent the internal portion within the hollow inner core. The first end opening is sealed by the valve lip. The tube has a second end opening adjacent the external portion exterior the hollow inner core of the bladder. The tube has an outer surface being in contact with the cylindrical stem of the bladder. The tube operates as an air valve when the second end opening receives an amount of the inflation medium that is passed therethrough. The air forces the valve lip away from the first end opening to enter into the hollow inner core. The amount of air passes into the hollow for expansion of the bladder when the cap is removed from the external portion, and the bladder is placed is within the paint can. Lastly, a disc-like sealing piece is attached to an interior side of a valve lip. The sealing piece rests against the first end opening of the tube and the internal portion of the bladder. The sealing piece provides an air-tight sealing of the tube within the hollow inner core.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved paint bladder which has all of the advantages of the prior art inflatable containers and none of the disadvantages.

It is another object of the present invention to provide a new and improved paint bladder which may be easily and efficiently manufactured and marketed.

It is further object of the present invention to provide a new and improved paint bladder which is of durable and reliable constructions.

An even further object of the present invention is to provide a new and improved paint bladder which is susceptible of a low cost of manufacture with regard to both materials and labor, and which accordingly is then susceptible of low prices of sale to the consuming public, thereby making such paint bladder economically available to the buying public.

Still yet another object of the present invention is to provide a new and improved paint bladder which provides in the apparatuses and methods of the prior art some of the advantages thereof, while simultaneously overcoming some of the disadvantages normally associated therewith.

Even still another object of the present invention is to provide a paint bladder for placing an inflatable bladder with a constant diameter and variable length into a partially filled paint can, and further varying the length of the bladder with respect to the fill level of the paint can.

Lastly, it is an object of the present invention to provide a new and improved paint bladder including a bladder that has an exterior surface and a top portion with a cylindrical extent. The extent has an external portion with a notch and an internal portion with a valve lip that is connected by a hinge. A slidably engages the external portion of the cylindrical extent for closure. Included is a hollow inner core that is accessible through the cylindrical extent, and for air containment. A rigid tube is positioned within the cylindrical extent. The tube has a first end opening that is sealed by the valve lip and a second end opening. Lastly, the tube operates as an air valve when the second end opening receives an amount of air therethrough and into the hollow for expansion of the bladder when the cap is removed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
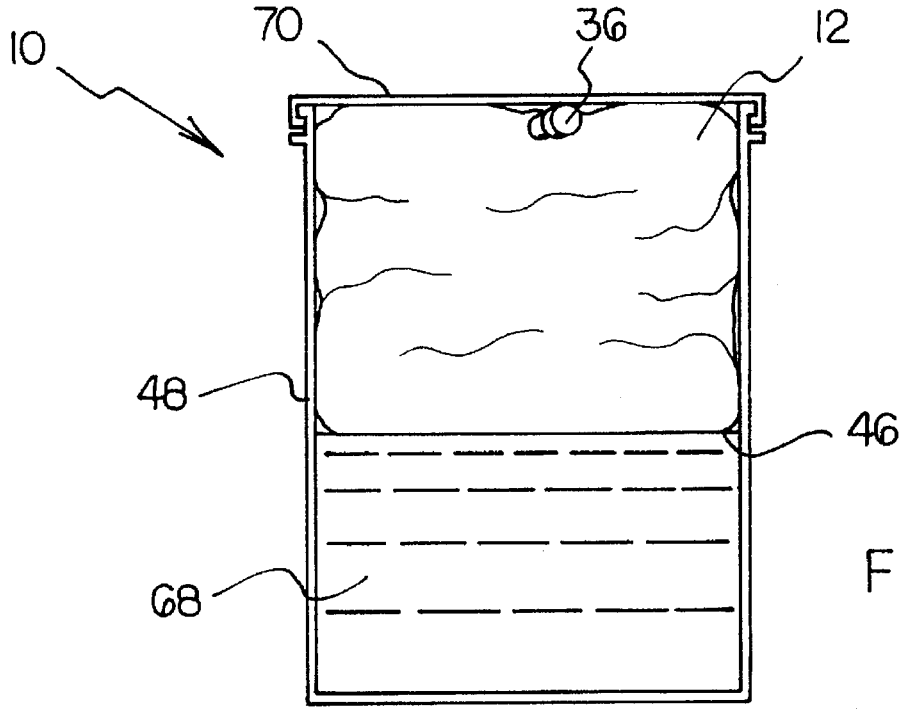
FIG. 1 is a perspective view of the preferred embodiment of the paint bladder constructed in accordance with the principles of the present invention.

With reference now to the drawings, and in particular to FIG. 1 thereof, the preferred embodiment of the new and improved paint bladder embodying the principles and concepts of the present invention and generally designated by the reference numeral 10 will be described.

The present invention, the paint bladder 10 is comprised of a plurality of components. Such components in their broadest context include a bladder, a stem, and a cap. Such components are individually configured and correlated with respect to each other so as to attain the desired objective.

Specifically, the present invention includes a collapsible pneumatic bladder 10, as shown in FIG. 1. The bladder has an elastomeric exterior surface 12, and a top portion 14, and a bottom portion 16. The top portion of the bladder has a cylindrical stem 18 with an internal portion 27 and an external portion 26. The cylindrical stem is formed of the same material used to form the bladder. The internal portion, of FIG. 5, has a valve lip 28 that is connected by a flexible hinge 32 and integral the stem. The external portion of the bladder has a notch encircling the exterior diameter of the stem. The notch being spaced from a top end 34 of the cylindrical stem.

The bladder is an inflatable bladder and is very flexible. The bladder may be formed of thermoplastic elastomeric, polyvinyl or polyethylene film, or rubber. These materials will allow the bladder to substantially conform to a variety of shapes. The materials are commercially available in powder, pellet, and film form, so that any one of them may be readily processed in extrusion and molding operations. The stem portion of the bladder is integral the bladder, and as such, is formed of the same material chosen in the formation of the bladder. The formation process used in making the bladder allows the exterior surface to be substantially smooth. The bladder is formed with uniform construction and no sealing bond, so as to decrease the likelihood of air seepage through the sealing bond.

Figure 2:
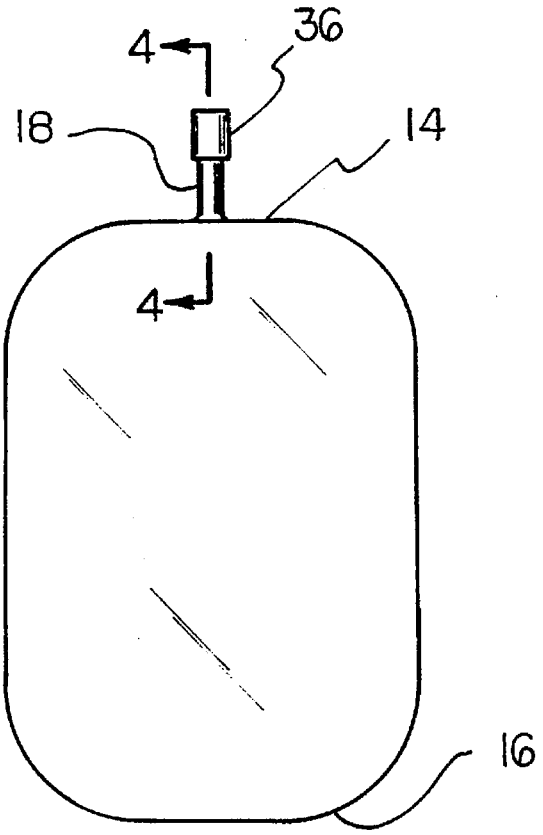
FIG. 2 is a perspective view of the bladder outside the paint can of FIG. 1.
Figure 4:
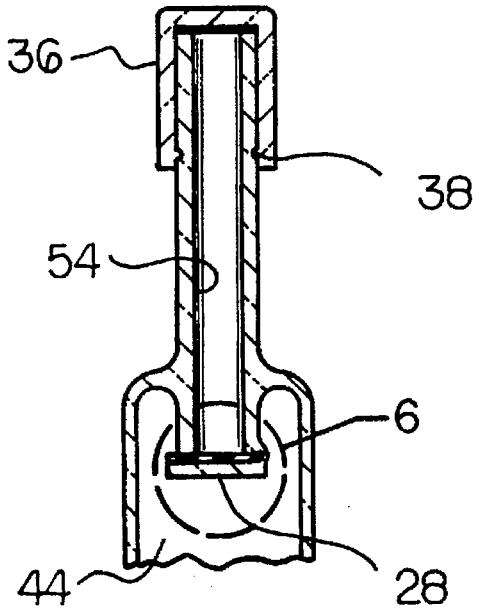
FIG. 4 is a cross sectional view of the stem of the present invention taken at line 4—4 of FIG. 2.

As best illustrated in FIG. 2, a generally cylindrical cap 36 is provided. The cap has a ridge 38 spaced from a bottom 42 of the cap. The ridge, as shown in FIG. 4, encircles the cap along an interior diameter of the cap. The cap is in slidable engagement with the external portion 26 of the cylindrical stem 18 of the bladder. The ridge of the cap lockingly engages the notch when the cap is placed over the stem. The notch and the ridge function in a snap-in manner when the cap is placed over the stem.

Figure 3:
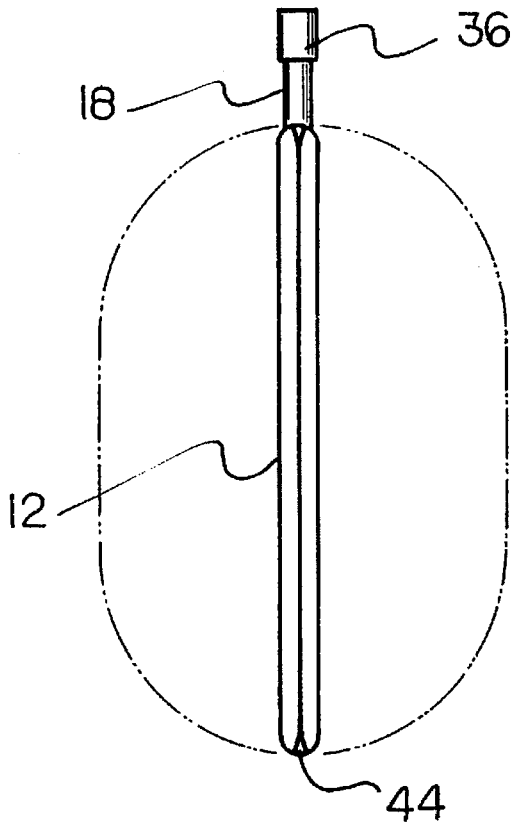
FIG. 3 is a side view of the present invention of FIG. 1.

A hollow inner core 44 is formed in the bladder. The hollow inner core holds a pressurized inflation medium within the bladder. The inner core has an inflatable shape, as illustrated in FIG. 3. The hollow inner core has a constant diameter and a variable length. The length, as shown in FIG. 1, approximates that of a paint level 46 within the paint can 48 in which the bladder is positioned. The bladder, once placed within the paint can, may be sealed within the paint can.

Figure 5:
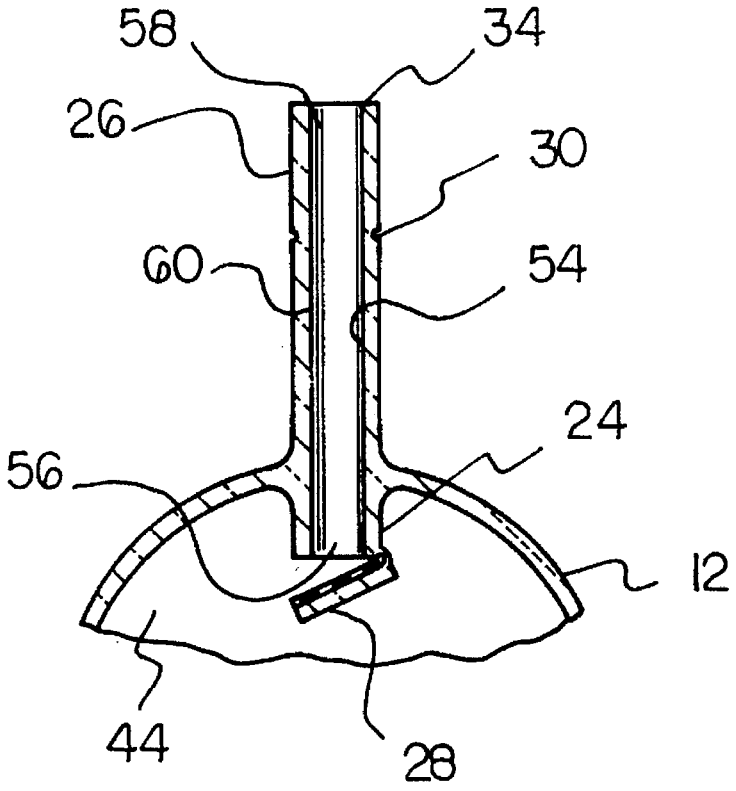
FIG. 5 is a fragmented elevational section of the present invention showing the valve lip opened.

Also, a rigid cylindrical tube 54 is positioned within the cylindrical stem of the top portion 14 of the bladder. The length of the tube, as shown in FIG. 4, is dictated by the length of the cylindrical stem 18. The tube has a first end opening 56, as shown in FIG. 5, adjacent the internal portion within the hollow inner core. The first end opening may be sealed by the valve lip 28. The tube has a second end opening 58 that is adjacent the top end 34 of the external portion, and exterior the hollow inner core 44. The tube has an outer surface 62 that is in gripping contact with the cylindrical stem for support against vertical movement within the stem.

The tube is formed of polyvinylchloride because it is lightweight and easy to work with. The tube functions as an air valve when the second end opening receives an amount of the inflation medium. The inflation medium may be helium, but is preferably carbon dioxide expended through normal breathing of a human. The inflation medium forces the valve lip 28 away from the first end opening 56, to allow the inflation medium to enter into the hollow inner core 44. The amount of inflation medium enters into the hollow and expands the bladder. The inflation medium enters the hollow when the cap is removed from the external portion and the bladder is placed in the paint can. As shown in FIG. 3, the bladder has a generally linear construction prior to inflation.

Figure 6:
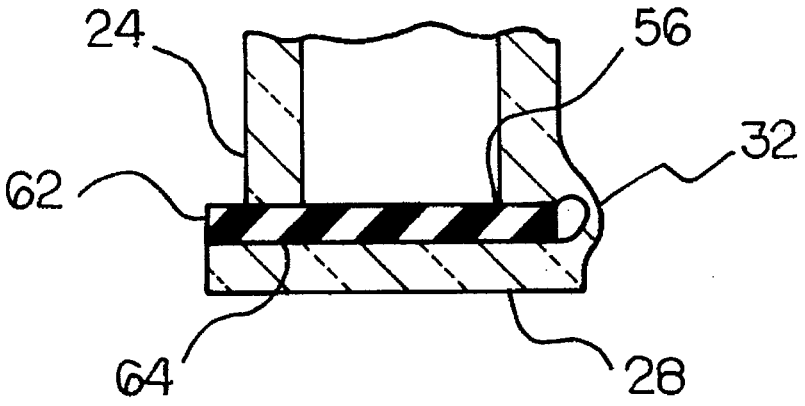
FIG. 6 is a fragmented elevational section of the present invention showing the valve closed taken at position 6 in FIG. 4.

Lastly, a disc-like sealing piece 62 is formed onto an interior side 64 of a valve lip 28. As shown in FIG. 6, the sealing piece rests against the first end opening 56 of the tube and the internal portion 24 of the bladder. The sealing piece provides an air-tight sealing of the tube within the hollow inner core. Additionally, the sealing piece and the valve lip operate as a one-way valve only allowing passage of the inflation medium in a single direction.

Furthermore, as best illustrated in FIG. 1, the bottom portion 16 of the bladder 10 rests upon the paint 16 in the paint can. The paint level is created from prior use of the paint within the paint can. The bladder is inflated slightly prior to placement into the paint can. Once the bladder rests upon the paint, it is inflated to a maximum capacity, in order to displace the air remaining in the paint can above the paint level. Once the bladder has displaced a sufficient amount of air, the cap 36 is placed over the external portion of the stem 18. The cap prevents any contaminants from entering into the interior hollow of the bladder. The paint can is resealed with a top 70, for storage of the remaining paint in the can. Placing the bladder in the paint can and resealing the paint can prevents a skim from forming at the paint level.

The present invention is an expandable bladder that may be inserted into a partially full paint can and blown up once placed within the can. The paint bladder is used to displace the air within the can so the remaining paint won't form a skim across its exposed surface. In preventing the skim, the paint remains fresh for use at a later date. The inflatable medium is blown into the interior hollow of the paint bladder through the tube that is positioned in the stem. The inflation medium allows the paint bladder to slightly float upon the top of the remaining paint in the paint can. The paint bladder has a exterior surface that is a non-stick surface and can be washed once the bladder is removed from the paint can. Once the bladder is placed into the paint and inflated, the cap is placed over the stem. Then the paint can itself is resealed. The bladder is easily formed and can come in sizes ranging to be positioned in a one gallon paint can, with a maximum size for positioning in a five gallon paint can. Use of the bladder is not limited to paint cans. The bladder may be used for other surface covering materials, such as varnish.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved paint bladder for placing in a partially filled paint can comprising in combination:

a collapsible pneumatic bladder having an elastomeric exterior surface, a top portion and a bottom portion, the bladder having a uniform construction and a smooth exterior for preventing air seepage from within the bladder, the bladder having a generally linear construction when at rest, the top portion of the bladder having a cylindrical stem with an internal portion and an external portion having a notch therearound, the internal portion having a valve lip being connected by a flexible hinge integral thereto;

a generally cylindrical cap having a ridge spaced from a bottom of the cap, the ridge encircling the cap along an interior diameter of the cap, the cap being capable of slidable engagement of the external portion of the cylindrical stem of the bladder, the ridge engaging the notch for allowing the cap to be lockingly positioned on the stem;

a hollow inner core for holding a pressurized inflation medium within the bladder, the inner core having an inflated shape with a constant diameter and a variable length which approximates that of a paint level within a paint can in which the bladder being positioned;

a rigid cylindrical tube positionable within the cylindrical stem of the top portion of the bladder, the tube having a length equal to a length of the stem, the tube having a first end opening adjacent the internal portion within the hollow inner core, the first end opening capable of being sealed by the valve lip, the tube having a second end opening adjacent the external portion exterior the hollow inner core of the bladder, the tube having an outer surface being in gripping contact with the cylindrical stem of the bladder for support against vertical movement within the stem;

the tube being capable of operating as an air valve when the second end opening receiving an amount of the inflation medium being passed therethrough, the inflation medium being capable of forcing the valve lip away from the first end opening for entering into the hollow inner core, the amount of the inflation medium capable of passing into the hollow for expansion of the bladder when the cap being removed form the external portion, the inflation medium being capable of causing the bladder to expand outwardly form the linear construction; and a disc-like sealing piece being formed onto an interior side of the valve lip, the sealing piece capable of resting against the first end opening of the tube and the internal portion of the bladder, the sealing piece being capable of providing an air tight sealing of the tube within the hollow inner core.

* * * * *